US010533755B2

(12) United States Patent
Cross et al.

(10) Patent No.: US 10,533,755 B2
(45) Date of Patent: Jan. 14, 2020

(54) HIDDEN VENTILATION TOE KICK

(71) Applicants: BSH Home Appliances Corporation, Irvine, CA (US); BSH Hausgeräte GmbH, Munich (DE)

(72) Inventors: Conor Cross, New Bern, NC (US); David Dysinger, New Bern, NC (US); Michael Gerdes, Trent Woods, NC (US); Phillip Montanye, New Bern, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 148 days.

(21) Appl. No.: 15/813,197

(22) Filed: Nov. 15, 2017

(65) Prior Publication Data

US 2019/0145630 A1 May 16, 2019

(51) Int. Cl.

| | |
|---|---|
| ***F24C 15/20*** | (2006.01) |
| ***F24C 15/32*** | (2006.01) |
| *A47L 15/48* | (2006.01) |

(52) U.S. Cl.

CPC ..... *F24C 15/2042* (2013.01); *F24C 15/2021* (2013.01); *F24C 15/322* (2013.01); *A47L 15/488* (2013.01); *A47L 2501/10* (2013.01)

(58) Field of Classification Search

CPC ..... F24C 15/32; F24C 15/20; F24C 15/2043; F24C 15/322; A47L 15/42

USPC ..... 126/21 A, 41 R

See application file for complete search history.

(56) References Cited

U.S. PATENT DOCUMENTS

| | | | | |
|---|---|---|---|---|
| 3,807,420 | A | 4/1974 | Donselman et al. | |
| 5,205,273 | A | 4/1993 | Sparks et al. | |
| 5,918,589 | A * | 7/1999 | Valle | F24C 15/2007 126/193 |
| 7,887,643 | B2 | 2/2011 | Stelzer et al. | |
| 8,522,768 | B2 * | 9/2013 | Zelek | A47J 37/0704 126/25 R |
| 9,427,133 | B2 * | 8/2016 | Rockwell | B32B 11/10 |
| 9,726,394 | B2 * | 8/2017 | Buchanan | F24F 13/0209 |
| 2011/0146657 | A1 | 6/2011 | Briedis et al. | |
| 2013/0316636 | A1 * | 11/2013 | Grimes | F24F 13/06 454/289 |
| 2016/0265797 | A1 * | 9/2016 | Bull | F24F 13/084 |

FOREIGN PATENT DOCUMENTS

WO 03063676 A1 8/2003

* cited by examiner

*Primary Examiner* — Edelmira Bosques
*Assistant Examiner* — Nikhil P Mashruwala
(74) *Attorney, Agent, or Firm* — Michael E. Tschupp; Andre Pallapies; Brandon G. Braun

(57) ABSTRACT

Strategies for providing aesthetically acceptable ventilation for appliances requiring ventilation are described. In one or more implementations, a notch is cut along the upper edge of a cabinet toe kick to allow ambient air to enter and exit an air cavity disposed behind the toe kick. A fence or trim piece is then installed in front of the notch to hide the notch from view and to create a labyrinth vent allowing ambient air to enter and exit the air cavity. This ambient air flow is required for proper operation of appliances requiring ventilation.

7 Claims, 3 Drawing Sheets

HIDDEN VENTILATION TOE KICK

FIELD OF TECHNOLOGY

The present technology relates to improvement in ventilation strategies for appliances requiring ventilation for proper operation.

BACKGROUND

Appliances generally require some form of ventilation for proper performance and operation. For freestanding appliances, ventilation is often provided by ambient air flow around the freestanding appliance. However, for built-in appliances that are installed or situated within a partly-enclosed space such as a cabinet, ambient air flow can be restricted and this restriction in air flow can result in reduced performance and operation of the built-in appliance.

Some attempted solutions to this problem utilize holes cut in the cabinet toe kick located below the built-in appliance to allow some ambient air to enter the cabinet and flow to the built-in appliance. To disguise or cover these holes, a cover of some type is used, such as a vent grill.

While this solution allows some ambient air to flow to the built-in appliance, vent grills are prominent, visible, and affect the overall aesthetic look of the cabinet and built-in appliance. Accordingly, what is needed is an aesthetically acceptable ventilation strategy for appliances that require ventilation for proper operation.

BRIEF SUMMARY

The present invention is directed to providing an aesthetically acceptable ventilation strategy for appliances requiring ventilation for proper operation. This is accomplished by cutting a notch along the upper edge of a toe kick and using a fence or trim piece disposed in front of the notch to create a labyrinth vent that allows ambient air to enter and exit an air cavity.

The fence or trim piece, which can be constructed out of any type of wood, plastic, metal, or combination thereof, hides the notch from a user's view and creates a more aesthetically pleasing ventilation strategy.

In a preferred embodiment the fence or trim piece can extend in length beyond the cabinet in which the built-in appliance is located, creating a uniform look as part of the whole cabinet assembly.

In a preferred embodiment, an air-permeable screen that is substantially the same height and length of the notch is disposed within the notch to prevent dirt, detritus, and other unwanted materials from entering the air cavity.

Various other objects, features, aspects, and advantages of the present invention will become more apparent to those skilled in the art upon review of the following detailed description of preferred embodiments of the invention and accompanying drawings in which like numerals represent like components.

DETAILED DESCRIPTION

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Throughout this disclosure, the terms top, bottom, front, back, left and right may be used. These terms are only intended to provide relational orientation with respect to one another. For example, any two opposed sides can be a right side and a left side and by changing to an opposed viewpoint, right versus left will be changed. Thus, top, bottom, front, back, left and right should not be considered limiting and are used only to distinguish their relationship to one another.

Figure 1:
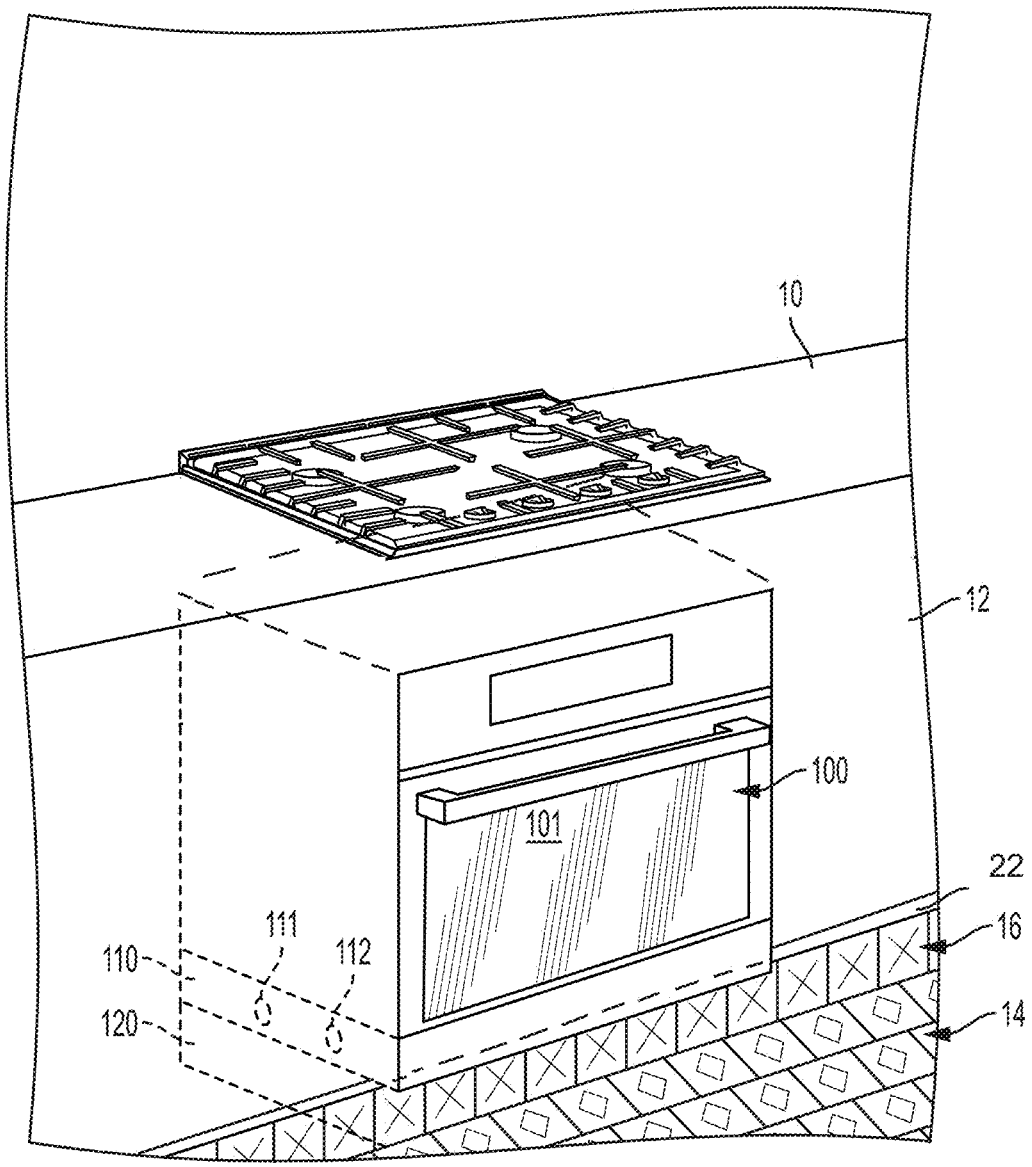
FIG. 1 is a perspective, front view of a hidden ventilation toe kick.

FIG. 1 illustrates a cooking area of a kitchen which may include counters 10 with cabinets 12 below the counters 10. The kitchen can include a floor 14. A toe kick 16 may be situated between the bottom of the cabinets 12 and the floor 14, the toe kick 16 being a recessed area allowing a kitchen user to stand close to the counters 10 and cabinets 12 without losing balance.

An appliance 100 with an appliance door 101 may be installed within the cabinets 12. As shown in FIG. 1, the appliance 100 can be configured as a slide-in appliance that fits flush to the adjacent cabinetry for a seamless, built-in look. Appliance 100 may be any manner of appliance, for example, a cooking appliance such as an oven or a microwave, or a refrigeration appliance.

Disposed below the appliance 100 and within the cabinets 12 is an air cavity 110. In the embodiment shown in FIG. 1, the air cavity 110 may be situated above a toe kick cavity 120. In alternative embodiments there may be no toe kick cavity 120 and the air cavity 110 is the only cavity disposed below the appliance 100.

As illustrated in FIG. 1, the toe kick 16 is disposed in front of the toe kick cavity 120. While the toe kick 16 generally runs uninterrupted from the bottom of the cabinets 12 to the floor 14, in front of the toe kick cavity 120 a notch is cut along the upper edge of the toe kick 16 creating a gap between the bottom of the cabinets 12 and the toe kick 16.

As a result of this notch, ambient air can flow into the toe kick cavity 120, which can then flow into the air cavity 110 through ventilation holes such as, for example, holes 111 and 112. This ambient air flow through the notch, the toe kick cavity 120, and the air cavity 110 creates a form of cabinet ventilation for the appliance 100 which exchanges air with the air cavity 110.

In an alternative embodiment where there is no toe kick cavity 120, ambient air flows through the notch directly into the air cavity 110, creating a form of cabinet ventilation for the appliance 100 which exchanges air with the air cavity 110.

As illustrated in FIG. 1, attached to the bottom of the cabinets 12 and disposed in front of the notch is a fence 22. The fence 22 may be constructed out of metal, plastic, wood, another suitable material, or any combination thereof.

As illustrated in FIG. 1, the fence 22 hides the notch from view and creates a more aesthetically acceptable ventilation strategy. The fence 22 can be longer than the notch and extend along the length of cabinets 12, creating a uniform look as a trim piece to the cabinets 12.

Figure 2:
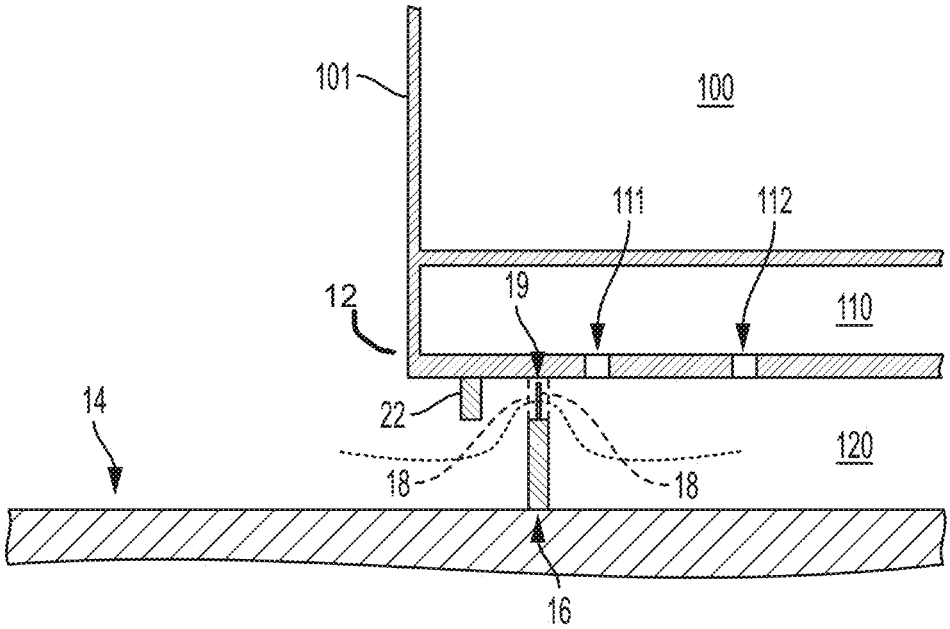
FIG. 2 is a side, cross-section view of a hidden ventilation toe kick.

FIG. 2 illustrates a cross section view of this ventilation strategy, wherein ambient air flows through notch 18.

As illustrated in FIG. 2, the air cavity 110 is disposed below the appliance 100. In the embodiment show in FIG. 2, the air cavity 110 may be situated above the toe kick cavity 120. In alternative embodiments there may be no toe kick cavity 120 and the air cavity 110 is the only cavity disposed below the appliance 100.

As illustrated in FIG. 2, the toe kick 16 is disposed in front of the toe kick cavity 120. Along the upper edge of the toe kick 16 a notch 18 is cut, creating a gap between the bottom of the cabinets 12 and the toe kick 16.

As illustrated in FIG. 2, attached to the bottom of the cabinets 12 and disposed in front of the notch 18 is fence 22. The fence 22 may be constructed out of metal, plastic, wood, another suitable material, or any combination thereof.

The fence 22 hides the notch 18 from view and creates a more aesthetically acceptable ventilation strategy. The fence 22 can be longer than the notch 18 and extend along the length of the cabinets 12, creating a uniform look as a trim piece to the cabinets 12.

As illustrated in FIG. 2, the fence 22 and the notch 18 create a labyrinth vent by which ambient air can flow into the toe kick cavity 120, which can then flow into the air cavity 110 through ventilation holes such as, for example, holes 111 and 112. This ambient air flow around the fence 22 and the notch 18, through the toe kick cavity 120, and into the air cavity 110 creates a form of cabinet ventilation for the appliance 100 which exchanges air with the air cavity 110.

As illustrated in FIG. 2, an air-permeable screen 19 may be disposed within the notch 18 to prevent debris from entering either the toe kick cavity 120 or the air cavity 110. The air-permeable screen 19 may be the same height and length of the notch 18, allowing the air-permeable screen 19 to completely cover the notch 18. The air-permeable screen 19 may be constructed out of metal, plastic, wood, another suitable material, or any combination thereof. The air-permeable screen 19 allows ambient air to freely flow through the notch and into the toe kick cavity 120.

In an alternative embodiment where there is no toe kick cavity 120, ambient air flows around the fence 22 and through the notch 18, passing through the air-permeable screen 19 directly into the air cavity 110, creating a form of cabinet ventilation for the appliance 100 which exchanges air with the air cavity 110.

Example Procedure

The following discussion describes techniques for providing an aesthetically acceptable ventilation strategy that may be implemented utilizing the previously described apparatuses. The procedures are shown as a set of blocks that specify operations to be performed by one or more persons or one or more devices and are not necessarily limited to the orders shown for performing the operations by the respective blocks. In portions of the following discussion, reference will be made to FIGS. 1 and 2.

Figure 3:
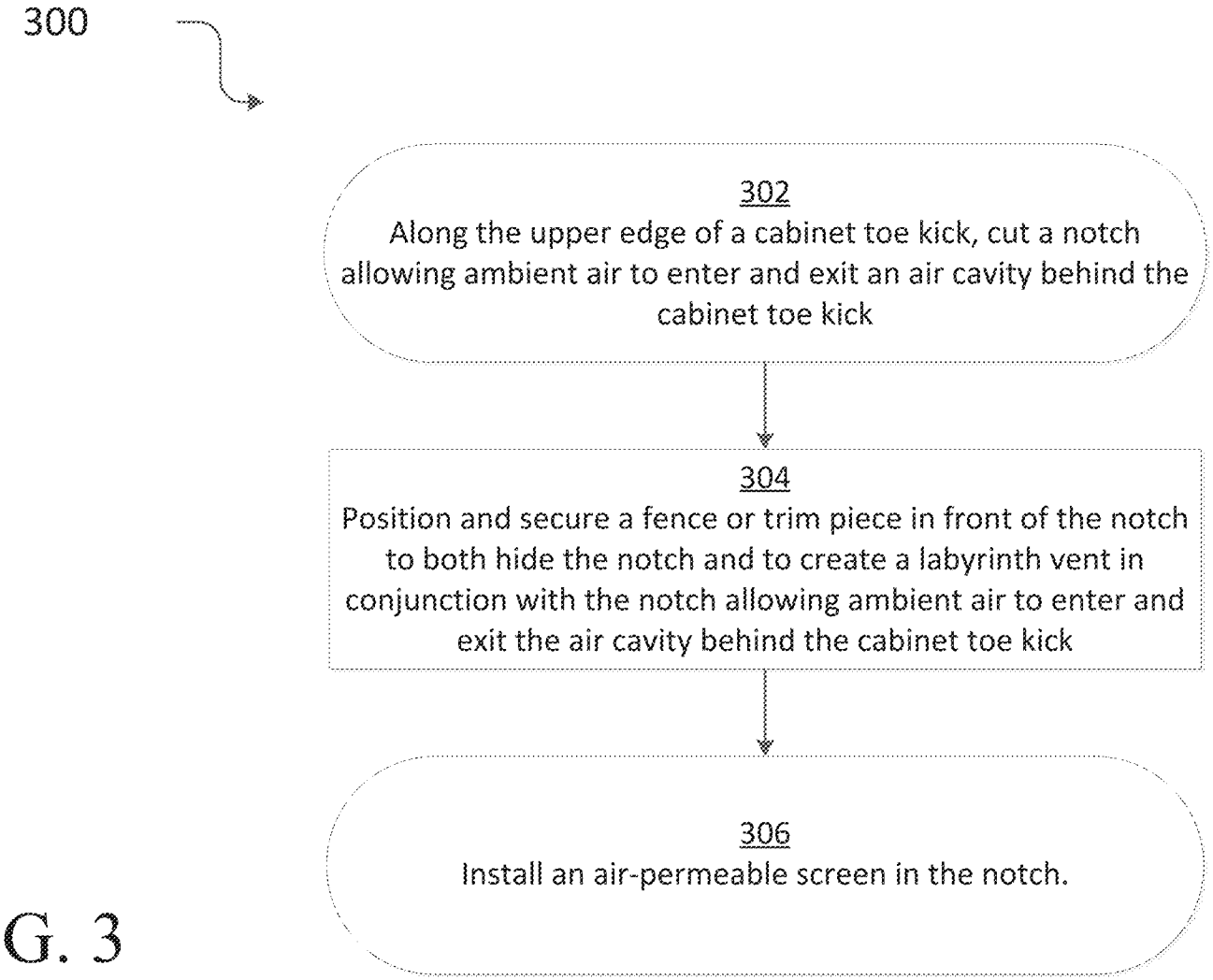
FIG. 3 is a flow diagram depicting a procedure in an example implementation in which an aesthetically acceptable ventilation strategy is installed.

FIG. 3 depicts a procedure 300 in an example implementation in which cabinet ventilation for a cooking appliance may be hidden in a cabinet toe kick.

A notch in the cabinet toe kick is cut along the upper edge of the cabinet toe kick (block 302), the notch allowing ambient air to enter and exit an air cavity located behind the cabinet toe kick.

A fence or trim piece is positioned in front of the notch and secured to the bottom of the cabinet (block 304), the fence or trim piece effectively hiding the notch and creating a labyrinth vent in conjunction with the notch allowing ambient air to enter and exit the air cavity.

Installed within the notch is an air-permeable screen (block 306) which prevents dust, detritus, or other undesired objects from passing through the notch into the air cavity.

While the present technology has been described in connection with several practical examples, it is to be understood that the technology is not to be limited to the disclosed examples, but on the contrary, is intended to cover various modifications and equivalent arrangements included within the spirit and scope of the technology.

What is claimed is:

1. A cabinet comprising:

an appliance cavity;

an air cavity disposed below the appliance cavity;

a toe kick disposed below the air cavity, wherein the toe kick is cut along an upper edge to create a notch, the notch allowing ambient air to enter and exit the air cavity located behind the cabinet toe kick; and a fence disposed in front of the notch, wherein the fence creates a labyrinth vent in conjunction with the notch allowing ambient air to enter and exit the air cavity.

2. The cabinet of claim 1, wherein the fence contains wood, plastic, metal, or a combination thereof.

3. The cabinet of claim 1, wherein, when viewed from the front of the cabinet, the fence hides the notch from view.

4. The cabinet of claim 1, wherein the fence extends in length beyond the cabinet.

5. The cabinet of claim 1, further comprising an air-permeable screen disposed within the notch.

6. The cabinet of claim 5, wherein the air-permeable screen is substantially the same height and length of the notch.

7. A method of hiding cabinet ventilation for a cooking appliance in a cabinet toe kick, the method comprising:

cutting a notch in the cabinet toe kick along an upper edge of the cabinet toe kick, the notch allowing ambient air to enter and exit an air cavity located behind the cabinet toe kick; and adding a trim piece in front of the notch, the trim piece hiding the notch and creating a labyrinth vent in conjunction with the notch allowing ambient air to enter and exit the air cavity.

* * * * *